US005125257A

United States Patent [19]

Worwag et al.

[11] Patent Number: 5,125,257

[45] Date of Patent: Jun. 30, 1992

[54] APPARATUS AND METHOD FOR DOMING BOTTOMS OF CONTAINERS

[75] Inventors: Randall S. Worwag, Arvada; Edward C. Miller, Broomfield, both of Colo.

[73] Assignee: Ball Corporation, Muncie, Ind.

[21] Appl. No.: 709,847

[22] Filed: Jun. 4, 1991

[51] Int. Cl.[5] ..... B21D 24/16

[52] U.S. Cl. ..... 72/348; 72/465

[58] Field of Search ..... 72/348, 351, 465; 267/119, 130

[56] References Cited

U.S. PATENT DOCUMENTS

| | | | |
|---|---|---|---|
| 2,331,491 | 10/1943 | Menkin | 72/351 |
| 4,289,014 | 9/1981 | Maeder et al. | 72/348 |
| 4,733,550 | 3/1988 | Williams | 72/348 |
| 4,930,330 | 6/1990 | Weishalla | 72/348 |

*Primary Examiner*—Lowell A. Larson

*Attorney, Agent, or Firm*—Gilbert E. Alberding

[57] ABSTRACT

Domer apparatus includes a housing having a cavity therein; an inner die being disposed in the cavity and being disposed around a longitudinal ram axis; an outer die being disposed in the cavity, being disposed around the longitudinal ram axis, and being disposed circumferentially around the inner die; second, third, and fourth springs being disposed in the cavity radially outward from the longitudinal ram axis, being circumferentially spaced-apart, and operatively engaging the inner die; and an air spring being disposed outwardly of the housing distal from the outer die, and providing a resilient force to the outer die along a plurality of paths that include a plurality of push rods, that are disposed radially outward of the longitudinal ram axis, and that extend longitudinally past the second, third, and fourth springs.

31 Claims, 2 Drawing Sheets

APPARATUS AND METHOD FOR DOMING BOTTOMS OF CONTAINERS

BACKGROUND OF THE INVENTION

1. Field of the Invention

The present invention relates generally to apparatus and method for reforming the bottoms of containers. More particularly, the present invention relates to apparatus and method for doming the bottoms of beverage container bodies that are drawn and ironed.

2. Description of the Related Art

Commonly, in the production of beverage containers, a cup is drawn, and then the cup is redrawn and ironed in a machine called a bodymaker. In the bodymaker, a ram, moving along a longitudinal and horizontal ram axis, functioning as a die punch, carries the cup through a first die wherein it is redrawn. Then, the ram carries the redrawn cup successively through a plurality of ironing dies, the metal of the sidewall being progressively thinned, and the height of the container body, or container shell, being successively increased.

Typical apparatus for performing these redrawing and ironing steps is taught by Grigorenko in U.S. Pat. No. 3,733,881, issued May 22, 1973.

Further, it is common practice to form the bottom of the container body, or container shell, with a contour that increases the static dome reversal pressure of the container, the objective being to obtain the greatest dome reversal pressure for a given metal thickness. More particularly, the objective has been to optimize the bottom contour, thereby both minimizing stock thickness and material cost, while maintaining the required static dome reversal pressure.

Various bottom contours have been used through the years. Presently, the most common bottom contour includes a spherical dome that curves upwardly into the container. A bottom contour that achieves increased bottom strength is taught by Baldwin in U.S. patent application Ser. No. 07/505,618, filed Apr. 6, 1990, of common ownership with the present patent application.

More recently, the primary emphasis on bottom strength has shifted from dome reversal pressure to drop resistance of the container as beverage bottlers have attempted to reduce their costs by eliminating case cartons, and, instead, have shrink wrapped case lots of beverages. This elimination of the case carton, and consequent elimination of the impact resistance of the cardboard carton, has resulted in an urgent need for container bottoms with increased drop resistance.

Presently, the drop resistance of beverage containers is determined by a drop test in which filled containers are dropped onto a steel plate from progressively increased heights; and the drop resistance is given as the cumulative sum of the drop heights prior to container failure.

Jentzsch et al. in U.S. patent applications Ser. Nos. 07/600,943 and 07/600,943, both filed Oct. 22, 1990, and both of common ownership with the present patent application, provide beverage containers with increased dome reversal pressures as well as increased cumulative drop height resistances.

Various types of tooling have been used for doming the bottoms of the beverage containers. Generally, the domer apparatus has been attached to the bodymaker coaxially with the ram thereof. Thus, after the ram has redrawn the cup, and after the ram, functioning as a die punch, has carried the redrawn cup through a progression of ironing dies to form a container shell, the ram then cooperates with the domer apparatus to form a recessed dome in the bottom of the container shell.

Paramonoff, in U.S. Pat. No. 3,771,345, issued Nov. 13, 1973, teaches a swinging-door mechanism for attaching domer apparatus to a bodymaker that is manufactured by Standun, Inc. of Compton, Calif.

In many prior art designs, the domer apparatus includes two dies, an inner die, and an outer die that is disposed circumferentially around the inner die. Both the inner and outer dies cooperate with the ram of the bodymaker. As the ram carries a container shell into contact with the domer apparatus, the outer die engages the bottom of the container shell radially outward of the area in which the bottom is to be domed. Then, as this outer die is allowed to be resiliently moved along with the container shell and the ram, the inner die is engaged, thereby forming a domed bottom in the container shell.

Preferably, the inner die is resiliently held in a longitudinal working position, as well as the outer die being resiliently held in a working position. Thus, in the event that a container shell becomes crumpled between the ram and the inner die, the inner die will move away from the ram without damaging either the bodymaker or the domer apparatus.

Prior art designs in which both the inner and outer dies are moveable and resiliently urged into their respective working positions include: Paramonoff, U.S. Pat. No. 3,771,345, issued Nov. 13, 1973; Maeder et al., U.S. Pat. No. 4,289,014, issued Sep. 15, 1981; Pulciano et al., U.S. Pat. No. 4,620,434, issued Nov. 4, 1986; Bulso, Jr. et al., U.S. Pat. No. 4,732,031, issued Mar. 22, 1988; Johansson et al., U.S. Pat. No. 4,790,169, issued Dec. 13, 1988; and Weishalla, U.S. Pat. No. 4,930,330, issued Jun. 5, 1990.

Of the above-listed prior art patents in which both the inner and outer dies are resiliently held in their respective working positions, Paramonoff, Maeder et al., Pulciano et al., and Bulso, Jr. et al. use a fluid actuator for resiliently positioning each of the two dies. Of these four prior art patents, Maeder et al. use external fluid actuators of the bag type; but the other three use internal fluid actuators of the piston type.

Of the remaining prior art patents in which both dies are resiliently positioned, Johansson et al. use springs for both dies, and Weishalla uses a fluid actuator for resiliently positioning the outer die, and a urethane spring for positioning the inner die.

Also of interest are Elert et al., U.S. Pat. No. 4,372,143, issued Feb. 8, 1983, and Williams, U.S. Pat. No. 4,733,550, issued Mar. 29, 1988. In both of these patents, a subassembly is provided that includes both the inner and outer dies. A first air spring is used to resiliently bias this subassembly, including the inner and outer dies thereof, toward the ram. If a container should become crumpled between the ram and the inner die, this first air spring allows the subassembly to move away from the ram, thereby preventing damage to the domer tooling and/or to the can maker.

A second air spring is included within the subassembly and is used to bias the outer die toward the ram. The second air spring, being smaller in diameter, provides a smaller resilient force than the first air spring. This smaller resilient force allows the outer die to move with the ram during the dome forming operation.

In these designs of Elert et al. and Williams, the smaller air spring, which is actuated with each cycle of the ram, is disposed inside the subassembly. Thus, a disadvantage of these designs is that extensive disassembly of the domer tooling is required for replacement of the air spring that operates the most frequently and that is most subject to failure.

Bodymakers typically operate at speeds of two hundred containers or more per minute; so the domer apparatus is subjected to rapid, repeated stresses. Further, as is true in any high production manufacturing process, it is important to reduce downtime; so a design objective is to be able to inspect and repair the domer apparatus in a minimum amount of time. Further, in order to minimize repair time, it is highly advantageous to be able to perform most repairs without removing the domer apparatus from the bodymaker. By avoiding the necessity of removing the domer apparatus from the bodymaker, time required to realign the domer apparatus to the bodymaker is obviated.

Therefore, the present invention incorporates the design objective of withstanding rapid and repeated stresses, reduction of mass of moving parts with a consequent reduction in inertial forces, elimination of heat sensitive and troublesome rubber seals, ability to dissipate heat generated by rapid operation, ability to inspect and repair the domer apparatus in a minimum amount of time, and ability to make most repairs without disassembly from the bodymaker.

Although no improvement in container strength was anticipated, and although the reasons are not readily apparent, the present invention increases the dome reversal pressures of containers by two to five pounds per square inch without any changes in the design of the dome or in the metal thickness. It is postulated that the reason for this unexpected improvement in container strength may be due to the lower operating mass of the parts associated with movement of the outer die and a resultant reduction in acceleration forces.

SUMMARY OF THE INVENTION

In the present invention, a domer apparatus is provided for attachment to a bodymaker having a ram that reciprocates along a longitudinal ram axis.

The means for attachment of the domer apparatus of the present invention to a bodymaker may be similar to that described in U.S. Pat. No. 3,771,345 issued to Paramonoff. However, the apparatus of the present invention may be attached by any suitable means to any bodymaker, such as those known as Ragsdale and Standun bodymakers.

The domer apparatus includes a housing having a cavity therein, and having a threaded flange with holes for screwing and bolting the housing to the bodymaker with the cavity disposed around the ram axis. An inner die is disposed in the housing cavity and is guided by the housing. An outer die is disposed circumferentially around the inner die; and the outer die is guided by the inner die.

A plurality of circumferentially spaced coil springs are disposed in the housing and operatively engage the inner die so that the inner die is resiliently urged to a working position against a stop. Another spring, which preferably is an air bag, is disposed longitudinally outward from the coil springs; and a plurality of circumferentially spaced push rods transmit the resilient force of the air bag longitudinally past the coil springs and against the outer die, thereby holding the outer die resiliently in a working position thereof.

The present design eliminates all sliding and static rubber seals, thereby providing reliability and long life. The air bag is located longitudinally outward of the housing, thereby allowing easy inspection and rapid replacement without the necessity of disassembling the domer apparatus from the bodymaker, or even disassembling the domer apparatus itself. The push rods cooperate with the air bag in allowing the location of the air bag to be longitudinally outward of the housing. Also, because of the low mass of the push rods, they achieve the goal of transmitting the force of the air bag longitudinally past the coil springs without appreciably increasing the mass of the parts associated with the outer die. The mounting system of the air bag is specifically designed so that the air bag can be exchanged in less than five minutes.

Finally, as an unexpected but highly desirable result, the reduced mass of the outer die parts, including the push rods, provides an increase in static dome reversal pressure of containers without any increase in metal thickness.

In a first aspect of the present invention, domer apparatus is provided for attachment to a bodymaker having a ram that reciprocates along a longitudinal ram axis, which apparatus comprises a housing having a cavity, and having means for attaching the housing to the bodymaker with the cavity disposed around the ram axis; an inner die being disposed in the cavity; an outer die being disposed in the cavity circumferentially around the inner die; means, including the housing, for guiding the inner and outer dies along the ram axis; a first spring being operatively attached to the housing; resilient means, including a second spring that is disposed longitudinally intermediate of the outer die and the first spring, and that operatively engages the housing, for resiliently urging one of the dies toward the bodymaker; and means, including a plurality of push rods that are disposed radially outward from the ram axis, and that are disposed longitudinally alongside the second spring, for transmitting a resilient force from the first spring to the other of the dies.

In a second aspect of the present invention, domer apparatus is provided for attachment to a bodymaker having a ram that reciprocates along a longitudinal ram axis, which apparatus comprises a housing having a cavity, and having means for attaching the housing to the bodymaker with the cavity disposed around the ram axis an inner die being disposed in the cavity an outer die being disposed in the cavity circumferentially around the inner die; means, including the housing, for guiding the inner and outer dies along the ram axis; a first spring being operatively attached to the housing; resilient means, including a second spring that is disposed longitudinally intermediate of the outer die and the first spring and that operatively engages the housing, for resiliently urging the inner die toward the bodymaker; and means for transmitting resilient force from the first spring to the outer die along a path that is radially outward from the ram axis, and that extends longitudinally past the second spring.

In a third aspect of the present invention, domer apparatus is provided for attachment to a bodymaker having a ram that reciprocates along a longitudinal ram axis, which apparatus comprises a housing having a cavity, and having means for attaching the housing to the bodymaker with the cavity disposed around the ram axis; an inner die being disposed in the cavity; an outer die being disposed in the cavity circumferentially around the inner die; means, including the housing, for guiding the inner and outer dies in movement along the ram axis; first resilient means, being operatively attached to the housing, for resiliently urging the outer die toward the bodymaker; second resilient means, being disposed in the cavity, for resiliently urging the inner die toward the bodymaker; and means, including the second resilient means being disposed longitudinally intermediate of the outer die and the first resilient means, for allowing removal of the first resilient means without the necessity of removing the second resilient means.

In a fourth aspect of the present invention, a method is provided for reforming bottoms of containers in cooperation with a bodymaker having a ram that moves along a longitudinal ram axis, which method comprises telescopically disposing inner and outer dies concentric with the ram axis; disposing a first resilient force device longitudinally proximal to the outer die and longitudinally distal from the ram; disposing a second resilient force device longitudinally intermediate of the first resilient force device and the outer die; transmitting force from the second resilient force device to one of the dies; and transmitting force from the first resilient force device to the other of the dies along a plurality of circumferentially spaced paths that are disposed radially outward of the ram axis, and that extend longitudinally past the second resilient force device.

In a fifth aspect of the present invention, a method is provided for reforming bottoms of containers in cooperation with a bodymaker having a ram that moves along a longitudinal ram axis, which method comprises telescopically disposing inner and outer dies concentric with the ram axis; disposing a first spring longitudinally proximal to the outer die and longitudinally distal from the ram; disposing a second spring longitudinally intermediate of the first spring and the outer die; transmitting force from the second spring to the inner die; and transmitting force from the first spring to the outer die along a path that is radially outward of the ram axis, and that extends past the second spring.

In a sixth aspect of the present invention, a method is provided for reforming bottoms of containers in cooperation with a bodymaker having a ram that moves along a longitudinal ram axis, which method comprises telescopically disposing inner and outer dies concentric with the ram axis; disposing a first spring longitudinally proximal to the outer die and longitudinally distal from the bodymaker; disposing a second spring longitudinally intermediate of the first spring and the outer die; encasing the second spring in a housing; transmitting force from the first spring, longitudinally into the housing and past the second spring to the outer die; and using the second spring to bias the inner die toward the ram of the bodymaker.

DESCRIPTION OF THE PREFERRED EMBODIMENTS

Figure 1:
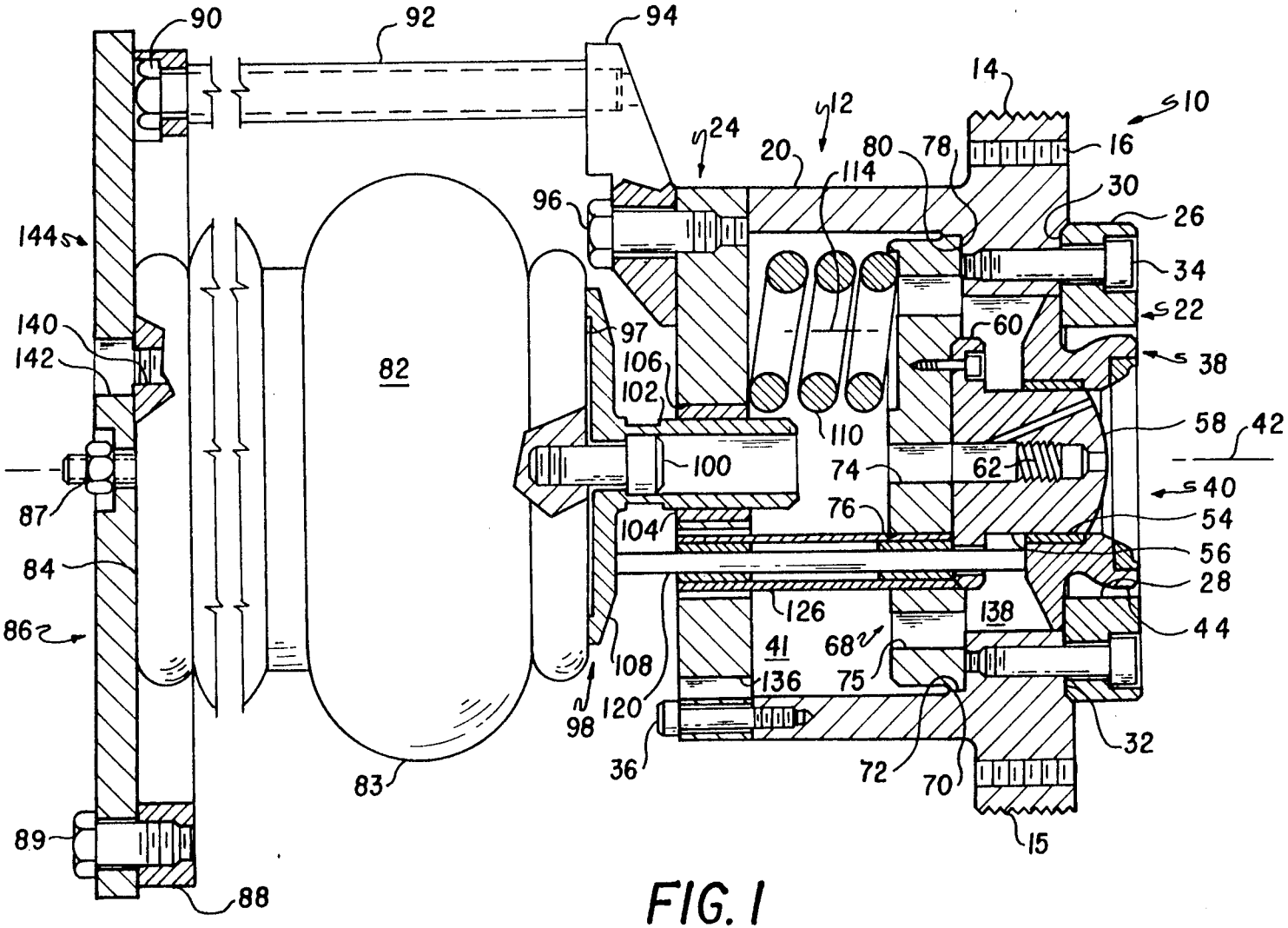
FIG. 1 is a longitudinal cross section of the domer apparatus of the present invention, including an externally-threaded flange with threaded holes for attachment of the domer apparatus to a bodymaker.
Figure 2:
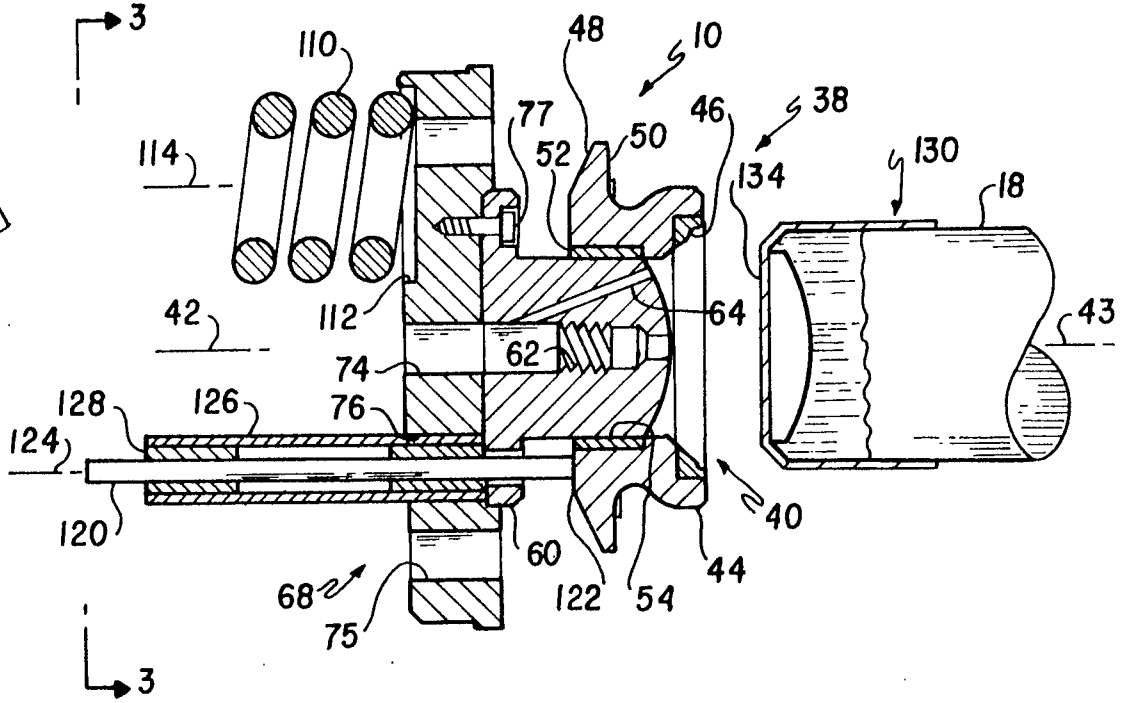
FIG. 2 is a longitudinal cross section of a portion of the domer apparatus of FIG. 1 shown together with partial longitudinal cross sections of both a ram of an associated bodymaker and a container shell carried by the ram.

Referring now to FIGS. 1 and 2, wherein FIG. 2 is provided primarily for the purpose of numbering the various parts without undue congestion, and wherein not all parts are numbered in either of these two FIGURES, domer apparatus 10 includes a housing 12, and a flange 14 with external threads 15 and threaded holes 16. The flange 14, together with the external threads 15 and the threaded holes 16 thereof, provide means for attaching the domer apparatus 10 to a ram 18 of a bodymaker (not shown) by means which is not shown and which is not a part of the present invention.

The housing 12 includes a body 20 of which the flange 14 is an integral part, a retainer plate 22, and a cover plate 24. The retainer plate 22 includes an outside cylindrical surface 26, an inside cylindrical surface 28, and an inner face 30. The retainer plate 22 is aligned with the body 20 by engagement of both the outside cylindrical surface 26 and the inner face 30 with a counterbore 32 of the body 20; and the retainer plate 22 is attached to the body 20 by cap screws 34. The cover plate 24 is attached to the body 20 by cap screws 36.

An outer die 38 is disposed circumferentially around an inner die, or domer die, 40. Both the outer die 38 and the inner die 40 are disposed in a cavity 41 of the housing 12, and are disposed along, and concentric with, a longitudinal domer axis 42. The domer apparatus 10 is attached to the bodymaker (not shown) with the longitudinal domer axis 42 coinciding with a longitudinal ram axis 43 of the ram 18.

The outer die 38 includes an outside surface 44 that is disposed in the inside cylindrical surface 28 of the retainer plate 22. However, the inside cylindrical surface 28 is approximately 0.015 inches in diameter larger than the outside surface 44 of the outer die 38; so the inside cylindrical surface 28 does not contact the outside surface 44 and does not provide any alignment for the outer die 38.

The outer die 38 further includes a hardened insert 46, a flange 48 with a face 50 that serves as a stop surface that cooperates with the inner face 30 of the retainer plate 22, and a sleeve bearing 52 that provides an inner guide surface 54. The inner die 40 includes an outer guide surface 56, a domer face 58, a flange 60, and a threaded hole 62.

The threaded hole 62 is used for installation of an insert (not shown, not a part of the present invention) having identifying indicia which is stamped on the bottom of the container shell during the doming operation. Angled holes 64 provide a plurality of paths for the escape of air and oil trapped between the ram 18 and the inner die 40.

A piston 68 is disposed in the cavity 41, includes an outside guide surface 70 that is slidably disposed in an inside guide surface 72 of the housing 12, a center hole 74, radially disposed holes 75, and guide-sleeve holes 76 that are longitudinally disposed, radially displaced, and circumferentially spaced apart.

The flange 60 of the inner die 40 is attached to the piston 68 by cap screws 77. The inner die 40 is positioned concentric to the longitudinal domer axis 42 and concentric to the longitudinal ram axis 43 by the outside guide surface 70 of the piston 68 slidably engaging the inside guide surface 72 of the housing 12, and by a surface 78 of the piston 68 engaging a stop surface 80 of the housing 12.

The outer die 38 is positioned concentric to the longitudinal domer axis 42 and concentric to the longitudinal ram axis 43 by the inner guide surface 54 of the outer die 38 slidably engaging the outer guide surface 56 of the inner die 40. Therefore, the outer die 38 is positioned and guided in movement along the longitudinal domer axis 42 and the longitudinal ram axis 43 by the inner die 40. However, since positioning and guiding of the inner die 40 and the outer die 38 ultimately rest on the inside guide surface 72 of the housing 12, broadly speaking, both the inner die 40 and the outer die 38 are guided for movement along the longitudinal domer axis 42 and the longitudinal ram axis 43 by the housing 12.

A first spring, or air spring, 82 includes two convolutions 83, and functions as a first resilient force device, and is disposed outside the housing 12 and distal from the ram 18 of the bodymaker (not shown). A first end 84 of the air spring 82 is attached to an outer plate 86 by a nut 87; the outer plate 86 is attached to a ring 88 by bolts 89; and the ring 88 is attached to the cover plate 24 of the housing 12 by bolts 90, spacers 92, threaded lugs 94, and bolts 96. A second end 97 of the air spring 82 is attached to a guide plunger 98 by a cap screw 100.

The guide plunger 98 includes an outer guide surface 102 that slidably engages a guide bushing 104 that is pressed into a hole 106 in the cover plate 24. The guide plunger 98 also includes a flange 108 that serves as a means for transferring the force of the air spring 82 radially outward.

A second spring, or coil spring, 110, serves as a second resilient force device, and is compressively interposed longitudinally intermediate of a counterbore 112 of the piston 68 and the cover plate 24; so that the second spring 110 resiliently presses the surface 78 of the piston 68 to a stop position against the stop surface 80 of the housing 12. The second spring 110 includes a longitudinal spring axis 114, that is disposed radially outward from the longitudinal domer axis 42.

Figure 3:
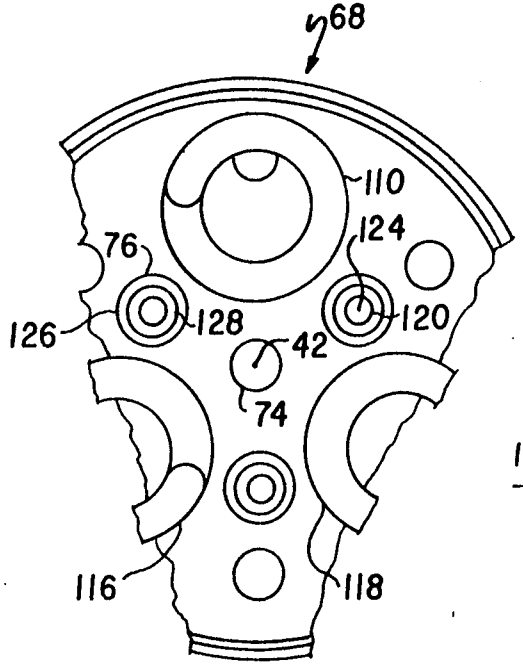
FIG. 3 is a partial end view, taken substantially as shown by view line 3—3, showing the three springs that resiliently urge the inner die to a stop position, the three push rods that transmit force from the air spring to the outer die, and the relationship of these three springs and three push rods to the longitudinal ram axis and the longitudinal domer axis.

The domer apparatus 10 also includes third and fourth springs, 116 and 118, as shown in FIG. 3, which are disposed radially outward from the longitudinal domer axis 42 and which are circumferentially spaced apart from the second spring 110.

Three push rods 120 are longitudinally disposed, are disposed radially outward of the longitudinal domer axis 42, engage the flange 108 of the guide plunger 98, engage an inside surface 122 of the outer die 38, and serve as a means for transmitting the force of the first spring 82 longitudinally along paths 124, and longitudinally past the second spring 110 to the outer die 38. As seen in FIG. 3, the paths 124 are disposed radially outward from the longitudinal domer axis 42 and are circumferentially spaced apart.

The push rods 120 are guided by guide tubes 126 that are pressed into the guide-sleeve holes 76 of the piston 68, and by bushings 128 that are pressed into the guide tubes 126.

When the domer apparatus 10 is attached to a bodymaker (not shown), the longitudinal domer axis 42 is coaxial with the longitudinal ram axis 43. That is, the longitudinal ram axis 43 is also the longitudinal axis of the outer and inner dies, 38 and 40.

In operation, a container shell 130 is carried by the ram 18 toward the domer apparatus 10. As can be seen in the drawings, the container shell 130 will engage the outer die 38 before engaging the inner die, or domer die 40. As the container shell 130 and the ram 18 engage the outer die 38, longitudinal movement of the outer die 38 away from the ram 18 will compress the air spring 82 as the push rods 120 transmit force from the inside surface 122 of the outer die 38, along the paths 124, past the second, third, and fourth springs, 110, 116, and 118, and against the flange 108 of the guide plunger 98.

In normal operation, the stroke of the ram 18, as related to the domer apparatus 10, is adjusted by means (not shown, not a part of the present invention) so that the inner die 40 will not be moved against the force of the second, third, and fourth springs, 110, 116, and 118. However, if a container shell 130 should become crumpled, and thereby present a thicker mass of material than that of a bottom 134 of the container shell 130, then the inner die 40 will move away from the ram 18, and against the load of the second, third, and fourth springs, 110, 116, and 118, to prevent damage of either the domer apparatus 10 or the bodymaker (not shown).

In the production of container shells, such as the container shell 130, copious quantities of lubricating fluids are supplied to the forming and ironing dies (not shown) of the bodymaker (not shown). The angled holes 64 provide means for excess lubricating fluid to be discharged into the cavity 41 of the housing 12; and a drain hole 136 in the cover plate 24 provides a path for the excess lubricating fluid to drain out of the domer apparatus 10.

As can be seen by examination of the drawings, the parts which are movable in normal operation, that is, those associated with the outer die 38, have a low mass. More particularly, the combined mass of the outer die 38, the push rods 120, the guide plunger 98, and a portion of the air spring 82 that is proximal to the guide plunger 98, is quite low in comparison to prior art designs.

This low mass results in lower operating stresses because the acceleration forces are reduced. However, as an unexpected result, the static dome reversal pressures average two to five p.s.i. higher for containers made with the domer apparatus 10, than for containers made with prior art configurations of domer apparatus.

The domer apparatus 10 provides long and trouble-free service because no rubber seals are used. Therefore, in comparison with prior art designs using pistons with elastomer sealing rings, the reliability and service life of the present device is highly superior.

The domer apparatus 10 is also superior in cooling. As can be seen by observation of the drawings, movement of the outer die 38 results in air being pumped between a chamber 138, which is a portion of the cavity 41, and the remainder of the cavity 41. Movement of air between the chamber 138 and the remainder of the cavity 41 results in cooling air being pumped in and out of the cavity 41.

Finally, the domer apparatus 10 is superior in ease and rapidity of maintenance and repair. The first spring, or air spring, 82 is replaceable by removing the bolts 89 and removing a hose fitting (not shown) from a port 140 of the air spring 82, the port 140 being accessible through a hole 142 in the outer plate 86. Then, a subassembly 144 which includes the guide plunger 98, the air spring 82, and the outer plate 86 can be removed from the domer apparatus 10. By keeping a spare of the subassembly 144, the air spring 82 and associated parts in the subassembly 144 can be replaced by inserting the bolts 89 and attaching a hose fitting (not shown) to the port 140. The repair time can be reduced further by using a quick-release fitting (not shown) in the port 140. Thus, by using an electric or air-actuated impact wrench, together with a quick-release air fitting, the air spring 82 can be replaced in only a minute or two, thereby greatly reducing downtime.

Preferably, the air spring 82 includes two convolutions 83, as shown; although an air spring with only a single convolution may be used and yields generally comparable results. More preferably, the air spring 82 used in the present invention is Style #26 with bead plate #7339, manufactured by the Firestone Rubber Company.

While specific apparatus and method have been disclosed in the preceding description, it should be understood that these specifics have been given for the purpose of disclosing the principles of the present invention and that many variations thereof will become apparent to those who are versed in the art. Therefore, the scope of the present invention is to be determined by the appended claims.

INDUSTRIAL APPLICABILITY

The present invention is applicable to production of containers and, more particularly, beverage containers having container shells that are seamlessly drawn and ironed. Still more particularly, the present invention is applicable for doming the bottom surfaces of body shells of beverage containers.

What is claimed is:

1. Domer apparatus for attachment to a bodymaker having a ram that reciprocates along a longitudinal ram axis, which apparatus comprises:

a housing having a cavity, and having means for attaching said housing to said bodymaker with said cavity disposed around said ram axis;

an inner die being disposed in said cavity;

an outer die being disposed in said cavity circumferentially around said inner die;

means, comprising said housing, for guiding said inner and outer dies along said ram axis;

a first spring being operatively attached to said housing;

resilient means, comprising a second spring that is disposed longitudinally intermediate of said outer die and said first spring, and that operatively engages said housing, for resiliently urging one of said dies toward said bodymaker; and means, comprising a plurality of push rods that are disposed radially outward from said ram axis, and that are disposed longitudinally alongside said second spring, for transmitting a resilient force from said first spring to the other of said dies.

2. Domer apparatus as claimed in claim 1 in which said one die comprises said inner die.

3. Domer apparatus as claimed in claim 1 in which said second spring comprises a mechanical spring.

4. Domer apparatus as claimed in claim 1 in which said second spring includes a longitudinal spring axis; and said spring axis is disposed radially outward from said ram axis.

5. Domer apparatus as claimed in claim 1 in which said resilient means comprises third and fourth springs; and said second, third, and fourth springs are disposed radially outward from said ram axis and said third and fourth springs are circumferentially spaced apart from said second spring.

6. Domer apparatus as claimed in claim 1 in which said first spring comprises an air spring.

7. Domer apparatus as claimed in claim 1 in which said housing includes a cover plate that is disposed intermediate of said dies and said first spring; and said apparatus comprises means for removing said first spring from said apparatus without removing said cover plate.

8. Domer apparatus as claimed in claim 1 in which said housing includes an inside guide surface;

said outer die includes an inner guide surface;

said inner die includes an outer guide surface;

said guiding means comprises said inner guide surface of said outer die slidably engaging said outer guide surface of said inner die; and said guiding means further comprises means, being operatively attached to said inner die, for slidably engaging said inside guide surface of said housing.

9. Domer apparatus as claimed in claim 1 in which said housing includes an inside guide surface;

said apparatus includes a piston that is inserted into said housing, and that is operatively attached to said inner die;

said outer die includes an inner guide surface;

said inner die includes an outer guide surface;

said guiding means comprises said inner guide surface of said outer die slidably engaging said outer guide surface of said inner die; and said guiding means further comprises said piston slidably engaging said inside guide surface of said housing.

10. Domer apparatus as claimed in claim 1 in which said housing includes an inside guide surface;

said apparatus includes a piston that is inserted into said housing, and that is operatively attached to said inner die;

said outer die includes an inner guide surface;

said inner die includes an outer guide surface;

said guiding means comprises said inner guide surface of said outer die slidably engaging said outer guide surface of said inner die;

said guiding means further comprises said piston slidably engaging said inside guide surface of said housing;

said piston includes a plurality of longitudinally disposed, radially displaced, and circumferentially spaced holes;

said push rods extend longitudinally through respective ones of said holes in said piston;

said resilient means comprises third and fourth springs; and said second, third, and fourth springs are disposed radially outward from said ram axis and are circumferentially spaced apart.

11. Domer apparatus for attachment to a bodymaker having a ram that reciprocates along a longitudinal ram axis, which apparatus comprises:

a housing having a cavity, and having means for attaching said housing to said bodymaker with said cavity disposed around said ram axis;

an inner die being disposed in said cavity;

an outer die being disposed in said cavity circumferentially around said inner die;

means, comprising said housing, for guiding said inner and outer dies along said ram axis;

a first spring being operatively attached to said housing;

resilient means, comprising a second spring that is disposed longitudinally intermediate of said outer die and said first spring and that operatively engages said housing, for resiliently urging said inner die toward said bodymaker; and means for transmitting resilient force from said first spring to said outer die along a path that is radially outward from said ram axis, and that extends longitudinally past said second spring.

12. Domer apparatus as claimed in claim 11 in which said resilient means comprises third and fourth springs; and said second, third, and fourth springs are disposed radially outward from said ram axis and are circumferentially spaced apart.

13. Domer apparatus as claimed in claim 11 in which said outer die includes an inner guide surface;

said inner die includes an outer guide surface;

said guiding means comprises said inner guide surface of said outer die slidably engaging said outer guide surface of said inner die; and said guiding means further comprises one of said dies operatively engaging said housing.

14. Domer apparatus as claimed in claim 11 in which said housing includes an inside guide surface;

said apparatus includes a piston that is inserted into said housing, and that is operatively attached to said inner die;

said outer die includes an inner guide surface;

said inner die includes an outer guide surface;

said guiding means comprises said inner guide surface of said outer die slidably engaging said outer guide surface of said inner die; and said guiding means further comprises said piston slidably engaging said inside guide surface of said housing.

15. Domer apparatus as claimed in claim 11 in which said housing includes an inside guide surface;

said apparatus includes a piston that is inserted into said housing, and that is operatively attached to said inner die;

said outer die includes an inner guide surface;

said inner die includes an outer guide surface;

said guiding means comprises said inner guide surface of said outer die slidably engaging said outer guide surface of said inner die;

said guiding means further comprises said piston slidably engaging said inside guide surface of said housing;

said resilient means comprises third and fourth springs;

said second, third, and fourth springs are disposed radially outward from said ram axis and are circumferentially spaced apart; and said resilient urging of said inner die toward said bodymaker by said resilient means comprises said second, third, and fourth springs operatively engaging said piston.

16. Domer apparatus for attachment to a bodymaker having a ram that reciprocates along a longitudinal ram axis, which apparatus comprises:

a housing having a cavity, and having means for attaching said housing to said bodymaker with said cavity disposed around said ram axis;

an inner die being disposed in said cavity;

an outer die being disposed in said cavity circumferentially around said inner die;

means, comprising said housing, for guiding said inner and outer dies in movement along said ram axis;

first resilient means, being operatively attached to said housing, for resiliently urging said outer die toward said bodymaker;

second resilient means, being disposed in said cavity, for resiliently urging said inner die toward said bodymaker; and means, comprising said second resilient means being disposed longitudinally intermediate of said outer die and said first resilient means, for allowing removal of said first resilient means without the necessity of removing said second resilient means.

17. Domer apparatus as claimed in claim 16 in which said second resilient means comprises second, third and fourth springs; and said second, third, and fourth springs are disposed radially outward from said ram axis and are circumferentially spaced apart.

18. Domer apparatus as claimed in claim 16 in which said outer die includes an inner guide surface;

said inner die includes an outer guide surface;

said guiding means comprises said inner guide surface of said outer die slidably engaging said outer guide surface of said inner die; and said guiding means further comprises means, operatively engaging one of said dies, for slidably engaging said housing.

19. Domer apparatus as claimed in claim 16 in which said housing includes an inside guide surface;

said outer die includes an inner guide surface;

said inner die includes an outer guide surface;

said guiding means comprises said inner surface of said outer die slidably engaging said outer guide surface of said inner die;

said apparatus includes a piston that is inserted into said housing, and that is operatively attached to said inner die; and said guiding means further comprises said piston slidably engaging said inside guide surface of said housing.

20. A method for reforming bottoms of containers in cooperation with a bodymaker having a ram that moves along a longitudinal ram axis, which method comprises:

a) telescopically disposing inner and outer dies concentric with said ram axis;

b) disposing a first resilient force device longitudinally proximal to said outer die and longitudinally distal from said ram;

c) disposing a second resilient force device longitudinally intermediate of said first resilient force device and said outer die;

d) transmitting force from said second resilient force device to one of said dies; and e) transmitting force from said first resilient force device to the other of said dies along a plurality of circumferentially spaced paths that are disposed radially outward of said ram axis, and that extend longitudinally past said second resilient force device.

21. A method as claimed in claim 20 in which said transmitting of said force from said second resilient force device to one of said dies comprises transmitting force from said second resilient force device to said inner die.

22. A method as claimed in claim 20 in which said disposing of said second resilient force device comprises disposing said second resilient force device radially outward of said ram axis.

23. A method as claimed in claim 20 in which said disposing of said second resilient force device comprises disposing said second resilient force device radially outward of said ram axis; and said method further comprises disposing third and fourth resilient force devices radially outward of said ram axis, circumferentially spaced from said second resilient force device, and longitudinally intermediate of said first resilient force device and said inner die.

24. A method as claimed in claim 20 in which the first disposing step comprises disposing an air spring.

25. A method as claimed in claim 20 in which said method further comprises removing said first resilient force device without obviating the first transmitting step.

26. A method as claimed in claim 20 in which said method further comprises removing said first resilient force device without affecting said telescopic disposing step.

27. A method as claimed in claim 20 in which said method further comprises removing said first resilient force device without obviating any of said plurality of circumferentially spaced paths.

28. A method as claimed in claim 20 in which said method further comprises removing any of said plurality of circumferentially spaced paths without affecting the first transmitting step.

29. A method as claimed in claim 20 in which said method further comprises transmitting said force from said first resilient force device radially outward prior to said transmitting of said force along said plurality of circumferentially spaced paths.

30. A method for reforming bottoms of containers in cooperation with a bodymaker having a ram that moves along a longitudinal ram axis, which method comprises:

a) telescopically disposing inner and outer dies concentric with said ram axis;

b) disposing a first spring longitudinally proximal to said outer die and longitudinally distal from said ram;

c) disposing a second spring longitudinally intermediate of said first spring and said outer die;

d) transmitting force from said second spring to said inner die; and e) transmitting force from said first spring to said outer die along a path that is radially outward of said ram axis, and that extends past said second spring.

31. A method for reforming bottoms of containers in cooperation with a bodymaker having a ram that moves along a longitudinal ram axis, which method comprises:

a) telescopically disposing inner and outer dies concentric with said ram axis;

b) disposing a first spring longitudinally proximal to said outer die and longitudinally distal from said bodymaker;

c) disposing a second spring longitudinally intermediate of said first spring and said outer die;

d) encasing said second spring in a housing;

e) transmitting force from said first spring, longitudinally into said housing and past said second spring to said outer die; and f) using said second spring to bias said inner die toward said ram of said bodymaker.

* * * * *